US006409792B1

(12) United States Patent
Schutz et al.

(10) Patent No.: US 6,409,792 B1
(45) Date of Patent: Jun. 25, 2002

(54) PROCESS FOR MELTING AND CASTING RUTHENIUM-CONTAINING OR IRIDIUM-CONTAINING TITANIUM ALLOYS

(75) Inventors: Ronald W. Schutz, Canfield; Kuang-O Yu, Highland Heights; Richard L. Porter, Boardman; Frank P. Spadafora, West Niles, all of OH (US)

(73) Assignee: RMI Titanium Company, Niles, OH (US)

( * ) Notice: Subject to any disclaimer, the term of this patent is extended or adjusted under 35 U.S.C. 154(b) by 0 days.

(21) Appl. No.: 09/707,829

(22) Filed: Nov. 6, 2000

(51) Int. Cl.[7] ..... C22B 34/12; C22C 1/03; C22C 14/00

(52) U.S. Cl. ..... 75/10.18; 75/10.19; 420/417; 420/590

(58) Field of Search ..... 75/10.19, 10.18; 420/590, 417

(56) References Cited

U.S. PATENT DOCUMENTS

| | | | | | |
|---|---|---|---|---|---|
| 3,063,835 A | | 11/1962 | Stern | | |
| 4,139,373 A | * | 2/1979 | Notton | ..... | 420/417 |
| 4,684,506 A | * | 8/1987 | Hahn et al. | ..... | 420/552 |
| 5,897,830 A | * | 4/1999 | Abkowitz et al. | ..... | 420/417 |

FOREIGN PATENT DOCUMENTS

SU 552365 A * 4/1977

OTHER PUBLICATIONS

R.W. Schutz & Ming Xiao "Corrosion: Specific Issues" Sep. 1993 vol. 3A.

R.W. Schutz Developments in Titanium Alloy Environmental Behavior 1995 no month.

R.W. Schutz "Ruthenium Enhanced Titanium Alloys" Platinum Metals Rev., 1996, 40, (2) 54–61 no month.

R.W. Schutz "Performance of Ruthenium–Enhanced Alpha–Beta Titanium Alloys in Aggressive Sour Gas and Geothermal Well Produced–Fluid BNrines" NACE International. 1997 no month.

R.W. Schutz "Recent developments in titanium alloy application in the energy industry" Elsevier Scien e S.A. 1998 no month.

R.W. Schutz "Lower Cose Ruthenium–Enhanced titanium Alloys for Severe Chemical Servie" First Interational Conference on reactive Metals in Corrosive Applications Sep. 12–16 1999.

R.W. Schutz "Titanium" Process Industries Corrosion –the therory and Practice NACE Publication 1986 Edition no month.

R.W. Schutz & Richard L. Porter TiRu–26 and –27: Lower–Cost, Corrosion–Resistant Titanium Alloys for Hydrometallurgical Process Equipment ALTA 2000 Nickel/Cobalt–6 May 15–18 2000.

R.W. Schutz & David E. Thomas Metals Handbook Ninth Edition vol. 13 Corrosion 1992 no month.

* cited by examiner

*Primary Examiner*—Roy King
*Assistant Examiner*—Tima McGuthry-Banks
(74) *Attorney, Agent, or Firm*—Sand & Sebolt

(57) ABSTRACT

An improved process for successful and homogeneous incorporation of ruthenium and iridium into titanium and titanium alloy melts, ingots, and castings via traditional melting processes (e.g., VAR and cold-hearth) has been developed. This result is achieved through the use of low-melting point Ti-Ru or Ti—Ir binary master alloys within the general composition range of ≦45 wt. % Ru and with a preferred composition of Ti-(15–40 wt. % Ru), or within the general composition range of ≦61 wt. % Ir and with a preferred composition of TI-(20–58 wt. % Ir). Primary features are its lower melting point than pure titanium, lower density than pure Ru and Ir metals, and the ability to be readily processed into granular or powder forms.

38 Claims, 4 Drawing Sheets

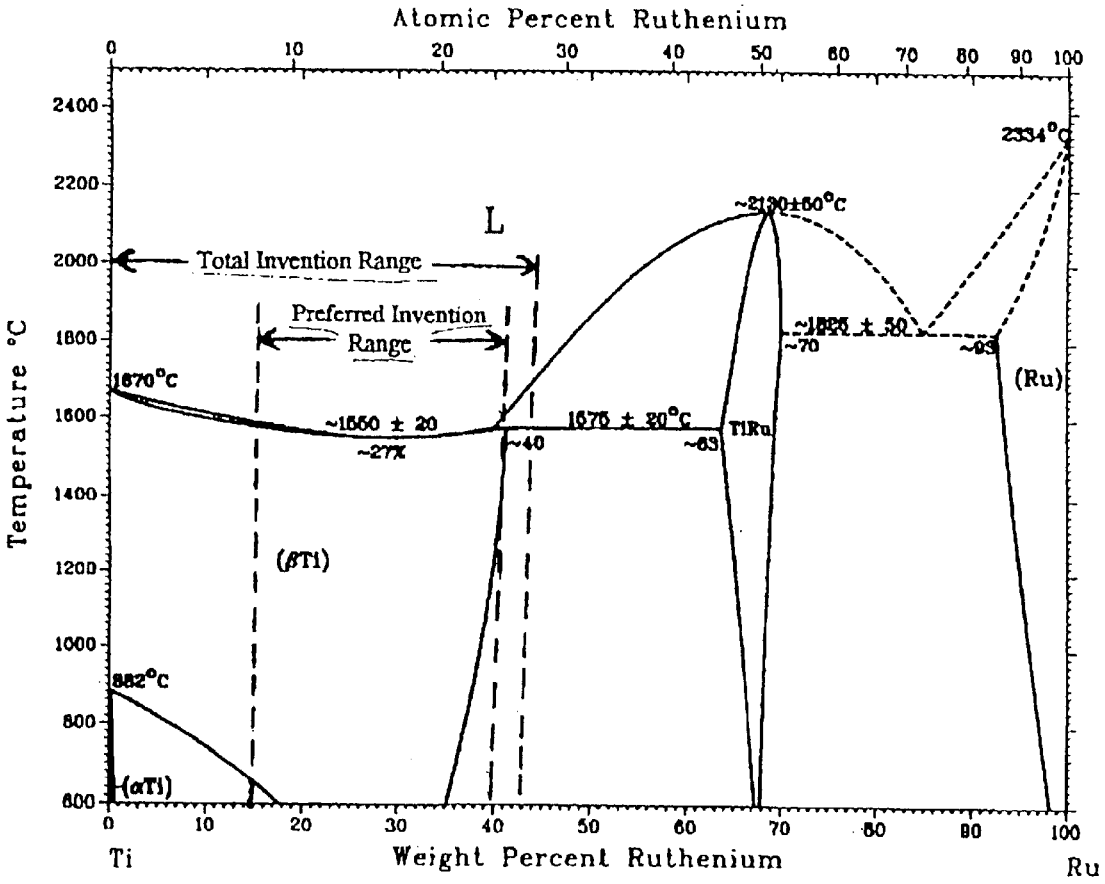
Figure 1: Titanium-Ruthenium binary alloy phase diagram

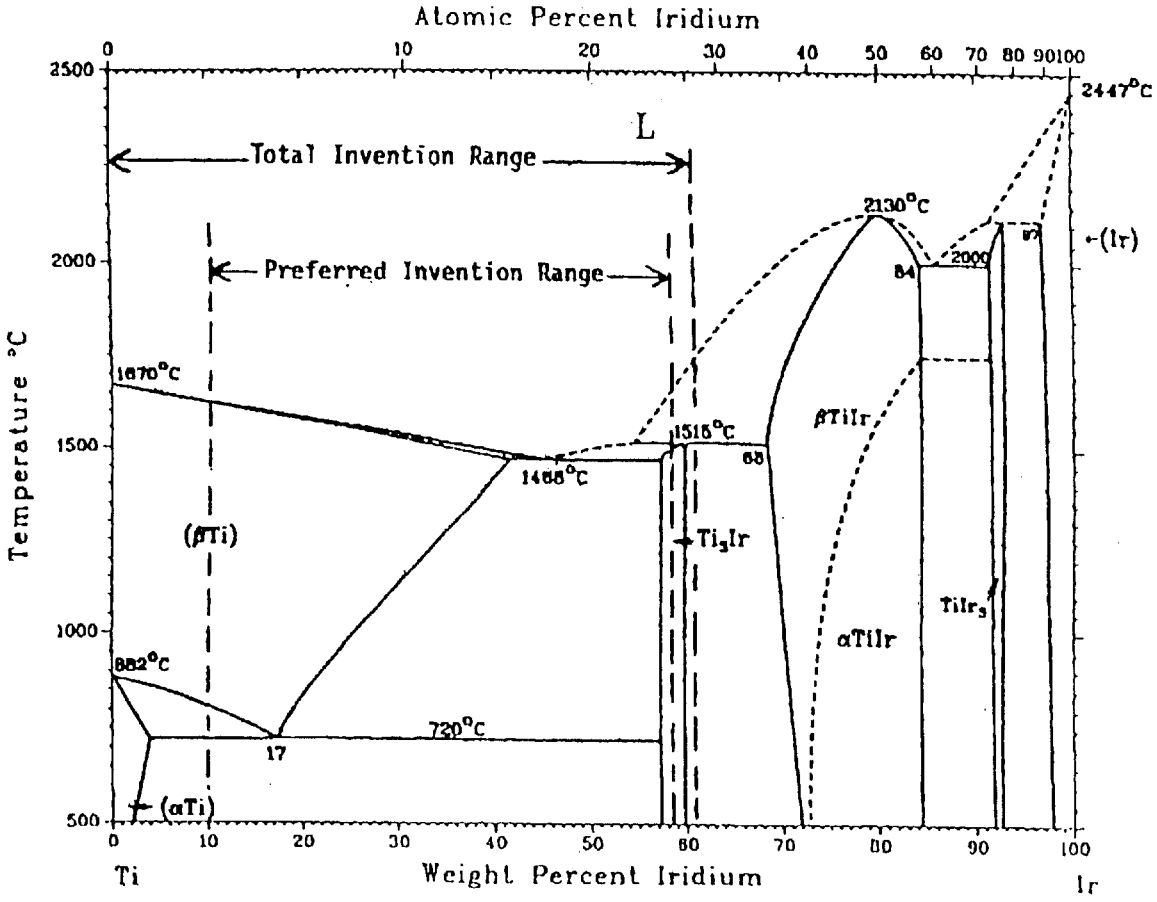
Figure 2 Titanium-Iridium binary alloy phase diagram(1)

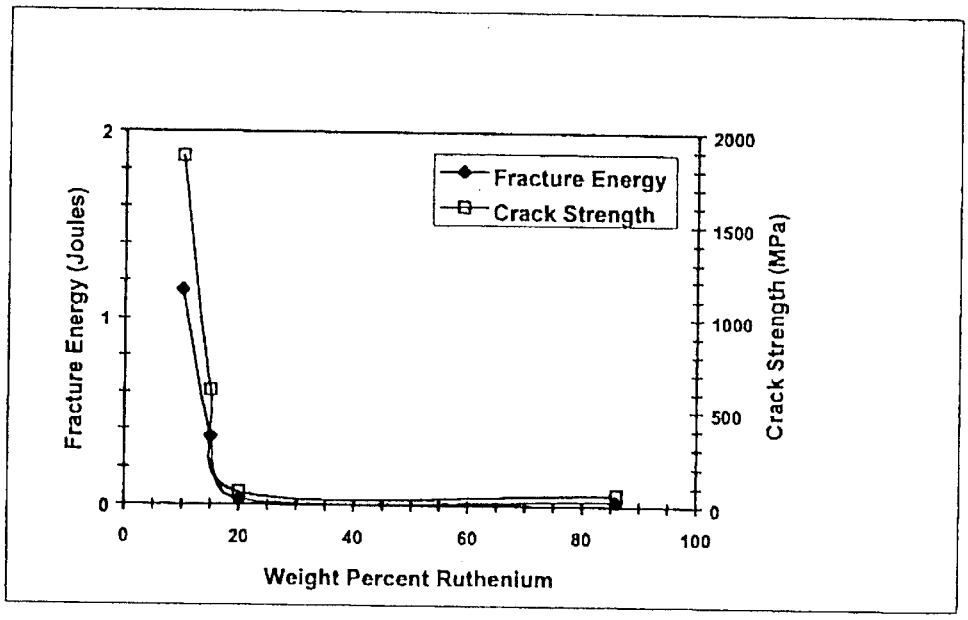
Figure 3: Room temperature fracture toughness properties of various Ti-Ru master alloy compositions (as-cast condition)

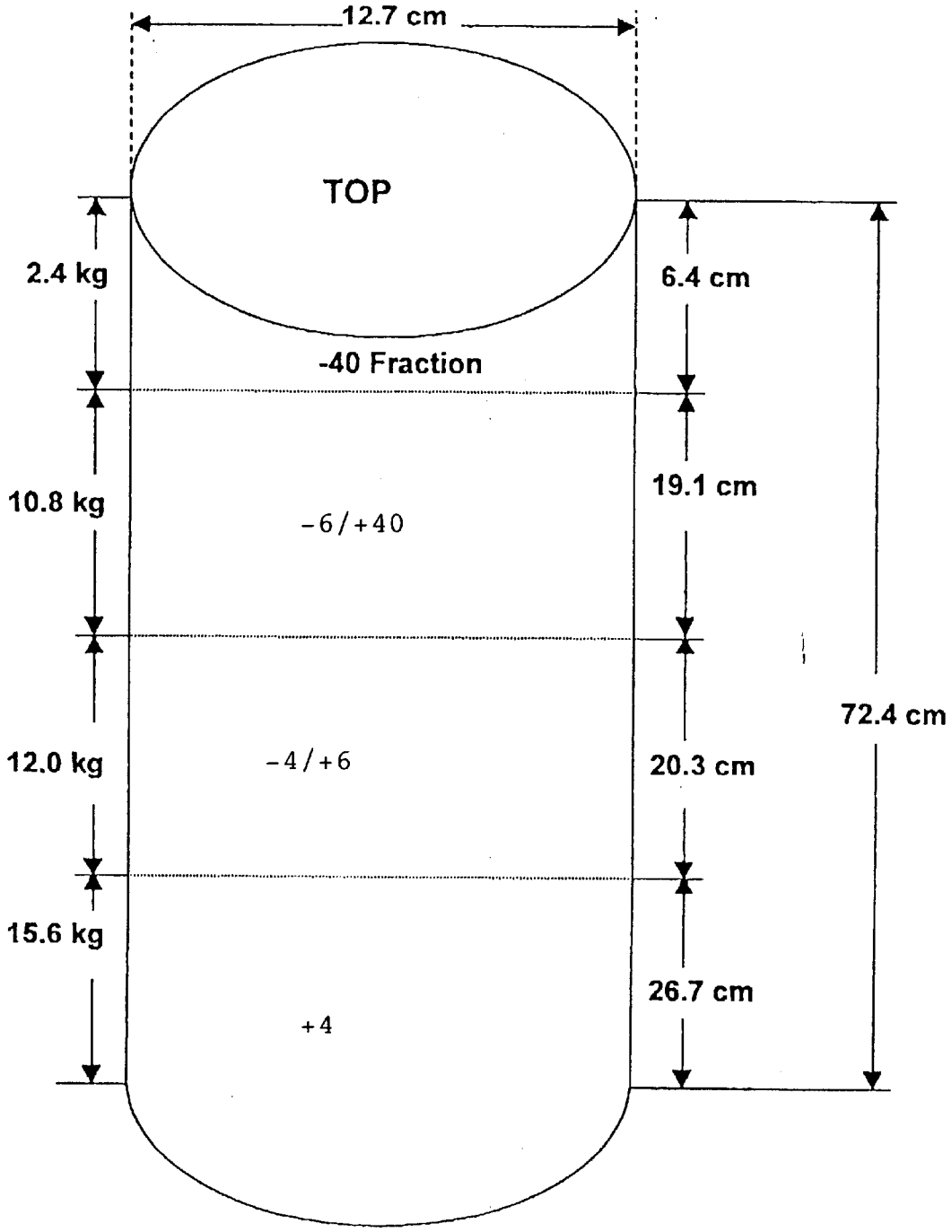
Figure 4: A 12.7 cm (41 kg) plasma-hearth ingot of Ti-0.11% Ru alloy formulated using four size fractions of Ti-30% Ru master alloy formulation as shown

PROCESS FOR MELTING AND CASTING RUTHENIUM-CONTAINING OR IRIDIUM-CONTAINING TITANIUM ALLOYS

BACKGROUND OF THE INVENTION

1. Technical Field

The present invention relates to processes for producing titanium alloys and more particularly to processes for melting and casting ruthenium and iridium containing titanium alloys.

2. Background Information

Platinum-group metals have been incorporated into various commercial titanium alloys over the past forty years primarily for the purpose of improving and expanding corrosion resistance. The most prominent examples are the Ti—Pd binary alloys, ASTM Grades 7 and 11 (Ti-0.15 wt. % Pd), and Grades 16 and 17 (Ti-0.05 wt. % Pd) which have been widely used in severe, corrosive service in the chemical process industry. This minor 0.04–0.25 wt. % Pd addition to etitanium and its alloys dramatically enhances its resistance to dilute reducing acid (HCl, $H_2SO_4$) media, as well as to crevice corrosion in hot chloride or halide salt solutions (brines).

The formulation, melting, and casting of these commercial Ti—Pd alloys is routinely and readily accomplished using the same standard, established methods/practices used for unalloyed titanium and most common titanium alloy mill products and components. This includes direct blending or addition of palladium metal powder to titanium metal sponge and/or revert, and subsequent melting via vacuum arc remelting (VAR), electron beam (EBM) melting, plasma arc melting (PAM), and VAR skull melting (for shaped castings) methods. These classic methods have produced acceptable, very chemically homogeneous ingots and castings stemming from palladium's slightly lower melting point than titanium (Table 1).

As the market price of palladium metal continued to rise, such as the '$140 to over $600 perTroy oz. increase in 1999, the price of Ti—Pd mill products became too exorbitant for most chemical process applications, and dramatically thwarted its selection and use. In an effort to provide lower cost substitutes for various expensive Ti—Pd alloys, various Ti—Ru binary alloys have been developed, such as ASTM Grades 26 and 27 (Ti-0.1 wt. % Ru). Such Ti—Ru alloys often exhibit comparable corrosion resistance and mechanical/physical properties to the Ti—Pd alloys. Since these alloys were formulated using ruthenium metal additions which are currently on the order of one-sixth the price of palladium, these Ti—Ru alloys also offer substantial cost savings over similar Ti—Pd mill products.

Over the past decade several commercial high-strength ruthenium-containing alpha-beta and beta titanium alloys have been developed and qualified. These alloys include ASTM Grades 29 (Ti-6Al4V-0.1 Ru), 28 (Ti-3Al-2.5V-0.1 Ru), and Ti-3Al-8V-6Cr4Zr-4Mo-0.1 Ru alloys, which are commercially utilized in high temperature, corrosive energy industry service, such as geothermal brine production well casing, oil/gas production tubulars and offshore riser components.

At the current price of $415.00/Troy oz., iridium metal is also a more cost effective alloy addition than Pd or Pt. Since iridium exhibits similar electrocatalytic behavior as Pt, the possibility exists that it can be added to titanium alloys in amounts as low as 0.05 wt. % nominally to enhance corrosion performance.

Although ruthenium (Ru) and iridium (Ir) are desirable, lower cost means of upgrading titanium alloy resistance than palladium (Pd), traditional methodologies forformulation and melting of Ru and Ir-containing titanium alloys based on direct elemental Ru or Ir metal additions to titanium melts pose distinct concerns and difficulties for achieving alloy compositional homogeneity. Specifically, ruthenium and iridium metals represent a "refractory", difficult-to-melt-in additions to titanium using traditional melting processes such as VAR and EBM/PAM hearth processes. Attempts to utilize accepted methods of direct addition of elemental powder employed successfully with Pd metal additions over the years, has been known to result in Ru macrosegregation and serious inhomogeneities with respect to Ru content in Ti-0.1Ru alloy ingots and castings. Although this gross inhomogeneity in Ru or Ir can be minimized in ingots/castings by direct Ru or Ir addition to individual Ti compacts, use of fine Ru or Ir powders, and/or improved blending with sponge granules, it is difficult to avoid. In fact, this problem is aggravated and enhanced when producing Ru- or Ir-containing Ti alloy heats via EBM or PAM hearth processes.

This difficulty in achieving homogeneous titanium melts using ruthenium metal additions primarily stems from ruthenium's and iridium's exceptionally high melting point and density, which are roughly 675° C. (1215° F.) and 781° C. (1406° F.) above that of pure titanium metal, respectively (see Table 1). In contrast Pd metal melts '110° C. (198° F.) below that of titanium. Furthermore, Ru and Ir metals both possess a substantially higher latent heat of fusion compared to either Ti or Pd metal (Table 1), which further inhibits their ability to transition from solid particle to liquid form (melt). On the other hand, Ru and Ir have a comparable specific heat but much higher thermal conductivity than Pd, which can be expected to partially counteract these refractory Ru and Ir properties which retard melt kinetics.

Two key factors for successful melting of any alloy addition into a titanium alloy melt are: 1) achieving sufficient temperature to exceed the melting point of the addition, and 2) allowing sufficient residence time of the particle addition within the high energy source and the superheated Ti melt to fully melt/dissolve the added particles. In the case of VAR melting of titanium from consumable electrodes, the pre-heated electrode compact adjacent to the electric arc becomes very hot and can pre-sinter compacted Ru and/or Ir metal powders into more difficult-to-melt, larger, consolidated clumps exhibiting low surface-to-volume ratio and a larger thermal mass. Pre-blending Ti compacts using very fine Ru or Ir powder helps, but classification and settling of the fine Ru or Ir powder mixed with coarse Ti metal sponge and other master alloy granules is inevitable and unavoidable prior to compacting. Although high temperatures well above ruthenium's and iridium's melting point are achieved within the electric arc, residence time is very short and actual Ru or Ir particle size mass can be too large to ensure total melting of refractory Ru or Ir additions. With ruthenium's and iridium's much higher density (Table 1) compared to Ti, these heavy unmelted Ru and Ir particles tend to settle rapidly within the liquid Ti melt causing macrosegregation and gross chemical inhomogeneity in ingots and castings.

Although Ru or Ir powder pre-sintering within electrode compacts is not a relevant concern in cold-hearth melt processes, the concern for incomplete Ru and/or Ir particle melting is even greater in these types of processes. This concern stems from:

1) The minimal, extremely short exposure of the solid Ti/Ru or Ti/Ir metal input mixture to either the electron beam or plasma arc as they raster across the metal and/or liquid melt surface.

2) The relatively low superheat in the titanium melt pool, involving temperatures well below ruthenium's or iridium's high melting point, and 3) The high density of unmelted Ru and Ir metal particles which promotes rapid settling (gross macro-segregation) of Ru and Ir particles within the very shallow Ti melt pool as it flows over the cold hearth.

SUMMARY OF THE INVENTION

It is an object of the present invention to provide an effective means for using Ru and Ir as a cost means of upgrading titanium alloy corrosion performance to achieve the required reducing acid, crevice, and stress corrosion.

The present invention is an improved process for successful and homogeneous incorporation of ruthenium into titanium and titanium alloy melts, ingots, and castings via traditional and contemporary melting processes (e.g., VAR and cold-hearth) has been developed. This is achieved through the use of low-melting point Ti—Ru binary master alloy within the general composition range of ≦45 wt. % Ru, and with a preferred composition of >15 wt. % and ≦40 wt. % Ru. For iridium a low melting point Ti—Ir binary master alloy containing ≦61 wt. % Ir, with a preferred range of >20 and ≦58 wt. % Ir. Desirable features as a master alloy for titanium melt processes are outlined in Table 4. Primary features are their lower melting point than pure titanium, lower density than pure Ru and Ir, and the ability to be readily processed into granular or powder forms.

BRIEF DESCRIPTION OF THE DRAWINGS

The preferred embodiment of the invention, illustrative of the best mode in which applicant contemplated applying the principles, is set forth in the following description and is shown in the drawings and is particularly and distinctly pointed out and set forth in the appended claims.

FIG. 1 is a titanium-ruthenium binary alloy phase diagram applicable to a preferred embodiment of the master alloy of the present invention;

FIG. 2 is a titanium-iridium binary alloy phase diagram applicable to an alternate preferred embodiment of the master alloy of the present invention;

FIG. 3 is a graph showing a room temperature fracture toughness of various Ti—Ru master alloy compositions of the present invention; and FIG. 4 is a schematic illustration of a cold-hearth ingot made according to the process of the present invention.

DESCRIPTION OF THE PREFERRED EMBODIMENTS

Ruthenium or iridium can be readily, homogeneously, and successfully incorporated into titanium and titanium alloy melts, ingots, and castings via traditional melting processes through the use of low-melting Ti—Ru or Ti—Ir binary master alloys within a specific composition range. These master alloys possesses a lower melting point and density than pure titanium and ruthenium/iridium, respectively, and are friable and can be easily granulated for formulation and blending with Ti sponge, etc., to produce compacts or direct granular feed for VAR, cold-hearth, and casting melt processes. Although the relevant Ti—Ru master alloy composition in this invention generally falls in the 0.5–45 wt. % Ru range, the preferred composition as a master alloy lies above 15 wt. % and less than or equal to 40 wt. %. For the Ti—Ir master alloy, the relevant composition claimed generally falls in the 0.5–61 wt. % to range with a preferred composition above 20 wt. % and less than or equal to 58 wt. % iridium.

Metallurgical Considerations—Ruthenium-rich binary Ti—Ru alloys are characterized by elevated melting points and difficult-to-melt, brittle phases. As shown in the published binary phase diagram for titanium-ruthenium in FIG. 1, ruthenium content above approximately 42–45 wt. % produces melting points well above those of pure titanium, approaching that of pure ruthenium [2237° C. (4239° F.)]. Furthermore, due to the significant difference in atomic radii between Ti and Ru, this Ru-rich regime involves formation of the very brittle intermetallic compound TiRu (Ti-67.5 wt. % Ru). This compound exhibits an elevated melting point of '2130° C. (3866° F.) which is also very difficult to melt via conventional VAR/Hearth melt processes. These Ru-rich compound-containing as-cast master alloy heats also did not remain monolithic and tended to experience severe, extensive cracking upon solidification and cooling (Table 2).

Although a lower melting eutectic composition occurs at 86 wt. % Ru (FIG. 1) which exhibits reasonable melt fluidity and did not crack-up after solidification/cooling, its melting point is roughly 1825° C. (3317° F.). This is still 163° C. (294° F.) above titanium's melting point and typical liquid melt temperatures.

Although their brittle nature may be of benefit for processing into master alloy granules or powders, these Ru-rich Ti—Ru master alloy compositions still possess high melting points, high density, and high heat of fusion compared to titanium. From a Ti alloy formulation standpoint, their high Ru contents can translate into greater inaccuracies in final ingot/casting Ru content due to greater analytical error and handling/processing losses prior to compacting or melting.

Iridium-rich binary Ti—Ir alloys are also characterized by elevated melting points and difficult-to-melt brittle phases. As indicated by the published binary phase diagram for titanium-iridium as depicted in FIG. 2, alloy melting points well above those of pure titanium can be expected when Ir content exceeds approximately 58–61 wt. %. Due to an even greater discrepancy in atomic radii between Ti and Ir, the Ir-rich side of the phase diagram tends to form brittle intermetallic compounds [$Ti_3Ir$ (26 wt. % Ir), TiIr (76 wt. % Ir), and $TiIr_3$ (92 wt. % Ir). Of these, the leaner $Ti_3Ir$ compound exhibits a melting point which is near that of titanium (~1670° C.). The other two compounds exhibit undesirable, elevated melting temperatures exceeding ~2000° C. These latter two compounds represent extremely difficult-to-melt master alloy additions via conventional VAR/hearth melt processes. Although these Ir-rich alloy compositions are brittle and friable for processing into master alloy granules/powders, they still possess an elevated melting point, high density, and a high heat of fusion compared to titanium.

a. Preferred Ti—Ru Master Alloy Composition—The Ru-lean Ti—Ru compositions (≦42 wt. % Ru), on the other hand, represent highly attractive master alloy additions to titanium and titanium alloys. As indicated in FIG. 1, the Ru-lean, regime consists primarily of beta phase titanium and no intermetallic compounds, possessing melting point temperatures below that of pure titanium. These compositions tend to exhibit rapid melting and good melt fluidity, and less tendency to "crack-up" severely after solidification/cooling (Table 2) due to internal residual stresses and absence of TiRu compound phase.

In addition to melting points below that of titanium, these lean-Ru master alloys possess physical properties approaching those of titanium such as lower latent heat of fusion and lower density. Furthermore, this low-to-intermediate Ru content in the master alloy addition translates into greater analytical accuracies with respect to Ru content and reduced error in Ti alloy formulation where the effect of master alloy losses during handling/processing prior to compacting/melting is mitigated.

Since this master alloy addition is desirable in granular or powder form, the preferred Ti—Ru composition range is further defined to be in the range from +20 wt. % to 58 wt. % Ir. This encompasses the compositions where the Ti—Ru master alloy exhibits a melting point below that of pure titanium and relatively good friability (brittle behavior) for easy, low-cost mechanical processing, (e.g. crushing) into granular form. The very low fracture toughness properties of as-cast Ti—Ru master alloys at room temperature are evident from FIG. 2 data plots. At and below roughly 15% Ru, the more ductile master alloy is much more difficult to granularize using standard impact and/or crushing methods under ambient conditions.

b. Preferred Ti—Ir MasterAlloy Composition—Ti—Ir compositions involving Ir levels below approximately 61 wt. % offer desirable properties as master alloy additions to titanium. This represents the range where the Ti—Ir master alloy's melting point is less than or equal to that of pure titanium. These compositions tend to exhibit rapid melting and good melt fluidity (Table 3). The leaner-Ir side of this range tends to offer master alloy properties which better approach those of titanium, such as lower latent heat of fusion and density.

Since this master alloy addition is desirable in granular or powder form, the preferred Ti—Ir composition range is further defined to be in the range of from >20 wt. % to 58 wt. % Ir. This encompasses compositions where the Ti—Ir master alloy exhibits a melting point wall below that of titanium and relatively good friability (Table 3) for easy, low-cost mechanical processing into granular form. Below roughly 20–25% Ir, the more ductile master alloy becomes much more difficult to granulize (crush) under ambient conditions.

The process and compositions of this invention is further disclosed with reference to the following examples.

EXAMPLE 1

Demonstration of Ti—Ru Master Alloy Use

This example demonstrates how a Ti—Ru master alloy described in this invention was used to produce a chemically homogeneous ingot of ASTM Grade 26 titanium (Ti-0.11% Ru). Specifically, this methodology was applied to formulation and melting of a 90 lb. (41 kg) plasma-hearth (PAM) ingot of Ti-0.1 Ru utilizing a wide range of Ti—Ru master alloy granule sizes.

A Ti-30 wt. % Ru master alloy was selected and produced for this example. A 250 gram button heat of this master alloy was prepared by plasma melting a pre-blended compact of titanium sponge granules and ruthenium metal powder. This button compact was melted in a Retech plasma button furnace using a plasma torch operating at 20 kW. The compact melted readily and exhibited high fluidity, and produced a monolithic button as expected. Chemical analysis confirmed that the whole button was homogeneous at 30±1 wt. % Ru. The melting point of this master alloy was estimated to be 1620° C. (2947° F.), based on melting points measured on the Ti-20% Ru and Ti40A% Ru master alloy buttons via precision extensometry under vacuum (1632° C. and 1606° C., respectively).

After crushing up this brittle master alloy button in a mortar and pestle, four size fractions of granules were screened: −40, 1–6/+40, −4/+6, and +4. Each of these four master alloy fractions was used to formulate compacts for separate zones within the final ingot as shown in FIG. 4. These master alloy granules were all well blended with commercial magnesium-reduced titanium sponge granules and pressed into 1200 gram compacts.

These compacts were melted in a Retech plasma hearth melting furnace using two plasma torches (150 kW hearth and crucible torches) each operating at 96 kW (FIG. 4). The final 12.7 cm (5") diameter, 41 kg ingot was sectioned axially through its mid-section to extract a 19 mm thick cross-sectional slice for evaluation of chemical and microstructural homogeneity. At least six locations per zone (FIG. 4) were analyzed with respect to ruthenium content. Based on a total of thirty analysis, the ruthenium content averaged 0.112 wt. % (0.120% max., 0.106% min.), with a very low standard deviation of 0.003 wt. %.

Therefore, not only was the nominal aim of 0.11% Ru met, the lack of significant deviation/scatter in Ru content indicated excellent ingot homogeneity/uniformity with respect to ruthenium. Microstructural examination of at least six mounted/polished/etched samples taken from this slice also consistently revealed a very fine, uniform dispersion of ruthenium-stabilized beta phase through the alpha-phase matrix. Extensive chemical analysis and microstructural examination of all four zones of this PAM ingot indicate that all ruthenium was thoroughly melted into and distributed homogeneously through this heat. This example confirms the viability of Ti—Ru master alloy utilization, even when using larger size fraction Ti—Ru master alloy granules for titanium alloy formulation.

EXAMPLE 2

Characterization of Ti—Ir Master Alloy Compositions

Three Ti—Ir master alloy compositions, Ti-10 wt. % Ir, Ti-20 wt. % Ir, and Ti-40 wt. % Ir, were produced and evaluated in the laboratory. These compositions were produced as 250 gram button heats in a Retech plasma button furnace. Compacts produced by blending pure Ir metal powder with titanium sponge granules were melted with plasma torch operating at 20 kW under an argon gas atmosphere.

Both buttons melted readily and exhibited excellent melt fluidity. The Ti-10% Ir and -20% Ir buttons remained monolithic, whereas the Ti-40% Ir button exhibited one single fracture upon solidification. Chemical analysis of these button heats revealed an iridium content of 9.0, 19.8 and 39.2 wt. %, respectively, and good overall chemical homogeneity. Melting points of these buttons were determined via precision extensometry under vacuum, and found to average 1680° C., 1630 and 1510° C., respectively. The Ti-10 Ir and -20 Ir buttons resisted fracture from hammer impact, whereas the Ti-40% Ir button readily shattered upon impact and/or light crushing. The ready friability of this Ti-40% Ir composition at room temperature explains why this composition lies in the "preferred" master alloy composition range.

250 gram button heats of Ti-0.05% Ir and Ti-0.1% Ir were subsequently produced in this plasma button furnace using the crushed Ti40% Ir button as master alloy. These Ti40% Ir granules were blended and compacted together with commercial magnesium-reduced titanium sponge. Chemical analysis of these button heats confirmed that the desired Ir content and homogeneity were achieved.

Accordingly, the improved PROCESS FOR MELTING AND CASTING RUTHENIUM-CONTAINING OR IRIDIUM-CONTAINING TITANIUM ALLOYS is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

TABLE 3-continued

PROPERTIES OF TI—IR MASTER ALLOY COMPOSITIONS CONSIDERED

| Wt. % Ir | Phases Present | Approx. Melting Pt. ° C. (° F.) | Gross Impact Toughness * | As-Cast Button Condition |
|---|---|---|---|---|
| 40 | β Ti + $Ti_3Ir$ cmpd. | 1510 (2750) | Very brittle/ shattered | Cracking |
| 84 | β Ti + $TiIr_3$ cmpd. | 2000 (3632) | Brittle | Could not melt/ consolidate |

TABLE 1

Comparison of Pure Metal Physical Properties Relevant to Melt Processes

| Property | Pure Metal Ti | Pd | Ru | Ir |
|---|---|---|---|---|
| • Melting Point | 1662° C. (3024° F.) | 1552° C. (2826° F.) | 2337° C. (4239° F.) | 2443° C. (4430° F.) |
| • Heat of Fusion | 15.5 KJ/mole | 17.6 KJ/mole | 24.0 KJ/mole | 26.1 KJ/mole |
| • Specific Heat | 0.52 KJ/kg · ° C. | 0.24 KJ/kg · ° C. | 0.24 KJ/kg · ° C. | 0.13 KJ/kg · ° C. |
| • Thermal Conductivity | 22 W/m · ° C. | 72 W/m · ° C. | 117 W/m · ° C. | 147 W/m · ° C. |
| • Density | 4.5 g/cm$^3$ | 12.0 g/cm$^3$ | 12.4 g/cm$^3$ | 22.5 g/cm$^3$ |

TABLE 2

Properties of Various Ti—Ru Master Alloy Compositions Considered

| Wt. % Ru | Phases Present | Approx. Melting Pt. ° C. (° F.) | Gross Impact Toughness* | As-Cast Button Condition |
|---|---|---|---|---|
| 10 | β Ti + α Ti | 1623 (2950) | fracture resistant | no cracking |
| 15 | β Ti + minor α Ti | 1602 (2913) | fracture resistant | no cracking |
| 20 | β Ti | 1587 (2890) | brittle | no cracking |
| 30 | β Ti | 1550 (2822) | very brittle/shattered | no cracking |
| 40 | β Ti + TiRu cmpd. (peritectic) | 1575 (2867) | very brittle/shattered | heavily fractured |
| 50 | β Ti + TiRu cmpd. | 1840 (3344) | very brittle/shattered | heavily fractured |
| 67.5 | TiRu compd. | 2130 (3866) | very brittle/shattered | heavily fractured |
| 86 | TiRu cmpd. + Ru (eutectic) | 1825 (3317) | brittle | no cracking |

*Based on simple hand-held hammer impact testing for gross embrittlement on as-cast button heats at room temperature.

TABLE 3

PROPERTIES OF TI—IR MASTER ALLOY COMPOSITIONS CONSIDERED

| Wt. % Ir | Phases Present | Approx. Melting Pt. ° C. (° F.) | Gross Impact Toughness * | As-Cast Button Condition |
|---|---|---|---|---|
| 10 | β Ti + α Ti + $Ti_3Ir$ cmpd. | 1680 (3056) | Fracture resistant | No cracking |
| 20 | β Ti + Ti + $Ti_3Ir$ cmpd. | 1630 (2966) | Fracture resistant | No cracking |

TABLE 4

UNIQUE, DESIRABLE FEATURES OF THE PROPOSED TI—RU AND TI—IR MASTER ALLOYS

* Lower melting point than pure titanium
* Dissolves readily into titanium and titanium alloy melts
* Significantly lower density than Ru and Ir metals
* Easily and inexpensively processed into granular or powder forms
* Possesses a desirable combination of lower specific heat and higher thermal conductivity than pure titanium for enhanced meltability into titanium
* Easy to melt master alloy compositions, which remain consolidated in as-cast form

Having now described the features, discoveries, and principles of the invention, the manner in which the PROCESS FOR MELTING AND CASTING RUTHENIUM-CONTAINING OR IRIDIUM-CONTAINING TITANIUM ALLOYS is practiced, constructed and used, the characteristics of the practice and construction, and the advantageous new and useful results obtained; the new and useful structures, devices, elements, arrangements, parts, and combinations are set forth in the appended claims.

What is claimed is:

1. A process for manufacturing an alloy comprising titanium and a second metal selected from the group consisting of ruthenium and iridium, said process comprising the steps of:

(a) producing a master alloy comprising titanium and said second metal, wherein said master alloy, titanium and said second metal each have a melting point, and said master alloy melting point is about equal to or lower than said titanium melting point, and said master alloy melting point is lower than said second metal melting point; and (b) reducing said master alloy produced in step (a) in size and then blending said reduced master alloy with a source of titanium.

2. The process of claim 1 wherein the master alloy formed in step (a) and said second metal each has a density and said master alloy density is less than said second metal density.

3. The process of claim 1 wherein the master alloy produced in step (a) is granulated in step (b).

4. The process of claim 3 wherein in step (b) the master alloy produced in step (a) is heated after said master alloy is reduced in size.

5. The process of claim 1 wherein in step (b) the source of titanium with which the master alloy produced in step (a) is mixed is titanium sponge.

6. The process of claim 4 wherein in step (b) the master alloy and source of titanium are melted.

7. The process of claim 4 wherein in step (b) the master alloy and source of titanium are cast.

8. The process of claim 1 wherein in step (b) the blended master alloy and the source of titanium are subjected to a vacuum-arc remelting (VAR) process.

9. The process of claim 6 wherein in step (b) the blended master alloy and the source of titanium are subjected to a cold-hearth, electron beam, or plasma arc melting.

10. The process of claim 1 wherein the master alloy melting point is substantially less than the second metal melting point.

11. The process of claim 1 wherein the master alloy is a binary alloy.

12. The process of claim 1 wherein the second metal is ruthenium.

13. The process of claim 12 wherein in step (a) the master alloy contains ruthenium in the amount of from about 0.5% to about 45% by weight.

14. The process of claim 13 wherein in step (a) the master alloy contains ruthenium in the amount of from above 15% to about 40% by weight.

15. The process of claim 14 wherein the master alloy is a binary alloy.

16. The process of claim 1 wherein the second metal is iridium.

17. The process of claim 16 wherein in step (a) the master alloy contains iridium in the amount of from about 0.5% to about 61% by weight.

18. The process of claim 17 wherein in step (a) the master alloy contains iridium in the amount of from above 20% to about 58% by weight.

19. The process of claim 18 wherein the master alloy is a binary alloy.

20. A product of the process for manufacturing an alloy comprising titanium and a second metal selected from the group consisting of ruthenium and iridium, said process comprising the steps of:

(a) producing a master alloy comprising titanium and said second metal, wherein said master alloy, titanium, and said second meal each have a melting point, and said master alloy melting point is about equal to or lower than either said titanium melting point, and said master alloy melting point is lower than said second metal melting point; and (b) reducing said master alloy produced in step (a) in size and then blending said reduced master alloy with a source of titanium.

21. The product of the process of claim 20 wherein the master alloy formed in step (a) has a density and said second metal has a density and said master alloy density is less than said second metal density.

22. The product of the process of claim 20 wherein the master alloy produced in step (a) is granulated in step (b).

23. The product of the process of claim 22 wherein in step (b) the master alloy produced in step (a) is heated after said master alloy is reduced in size.

24. The product of the process of claim 20 wherein in step (b) the source of titanium with which the master alloy produced in step (a) is mixed is titanium sponge.

25. The product of the process of claim 24 wherein in step (b) the master alloy and source of titanium are melted.

26. The product of the process of claim 24 wherein in step (b) the melted master alloy and source of titanium are cast.

27. The product of the process of claim 22 wherein in step (b) the blended master alloy and the source of titanium are subjected to a vacuum-arc remelting (VAR) process.

28. The product of the process of claim 20 wherein in step (b) the blended master alloy and the source of titanium are subjected to cold-hearth, electron beam, or plasma arc melting process.

29. The product of the process of claim 20 wherein the master alloy melting point is substantially less than the second metal melting point.

30. The product of the process of claim 20 wherein the master alloy is a binary alloy.

31. The product of the process of claim 20 wherein the second metal is ruthenium.

32. The product of the process of claim 30 wherein in step (a) the master alloy contains ruthenium in the amount of from about 0.5% to about 45% by weight.

33. The product of the process of claim 32 wherein in step (a) the master alloy contains ruthenium in the amount of from above 15% to about 40% by weight.

34. The product of the process of claim 33 wherein the master alloy is a binary alloy.

35. The product of the process of claim 20 wherein the second metal is iridium.

36. The product of the process of claim 35 wherein in step (a) the master alloy contains iridium in the amount of from about 0.5% to about 61% by weight.

37. The product of the process of claim 36 wherein in step (a) the master alloy contains iridium in the amount of from above 20% to about 58% by weight.

38. The product of the process of claim 37 wherein the master alloy is a binary alloy.

* * * * *